United States Patent [19]

Gfesser, Jr.

[11] Patent Number: 4,467,540

[45] Date of Patent: Aug. 28, 1984

[54] DESK CLOCK AND DISPLAY STAND

[76] Inventor: George Gfesser, Jr., 1017 Schoenbeck Rd., Prospect Hgts., Ill. 60070

[21] Appl. No.: 355,103

[22] Filed: Mar. 5, 1982

Related U.S. Application Data

[63] Continuation-in-part of Ser. No. 281,717, Jul. 9, 1981, abandoned.

[51] Int. Cl.[3] ..... G09F 3/04

[52] U.S. Cl. ..... 40/152.1; 40/10 D

[58] Field of Search ..... 40/10, 152.1, 10 D, 40/120; 248/454

[56] References Cited

U.S. PATENT DOCUMENTS

| | | | |
|---|---|---|---|
| 311,724 | 2/1885 | Crockett | 40/124.5 |
| 607,104 | 7/1898 | Whitehead | 40/152.1 |
| 619,743 | 2/1899 | Hathaway | 40/152.1 |
| 811,432 | 1/1906 | Peake | 40/124.5 |
| 2,223,308 | 11/1940 | Rovell | 40/152.1 |
| 2,775,424 | 12/1956 | Harris | 248/454 |
| 3,774,331 | 11/1973 | Coelho | 40/152.1 |
| 3,877,162 | 4/1975 | Wilson | 40/10 D |

FOREIGN PATENT DOCUMENTS

| | | | |
|---|---|---|---|
| 50035 | 3/1935 | Denmark | 40/152.1 |

*Primary Examiner*—Gene Mancene
*Assistant Examiner*—Wenceslao J. Contreras
*Attorney, Agent, or Firm*—Dussler, Goldsmith, Shore, Sutker and Milnamow

[57] ABSTRACT

A desk clock and display stand is disclosed having a frame with a cell to retain a display module, the frame being tiltably held to a base by a hinge means. The hinge means has a male hinge element having a generally cylindrical pin included with the frame and a female hinge element having a socket included with the base. The display module retains pictures, clocks or both on the frame visible through a clear window. The display module has a first plate portion joined to a second plate by a bridge section to bias opposite edges of the module against opposite borders of the cell to retain the module in the cell.

34 Claims, 18 Drawing Figures

FIG. 1
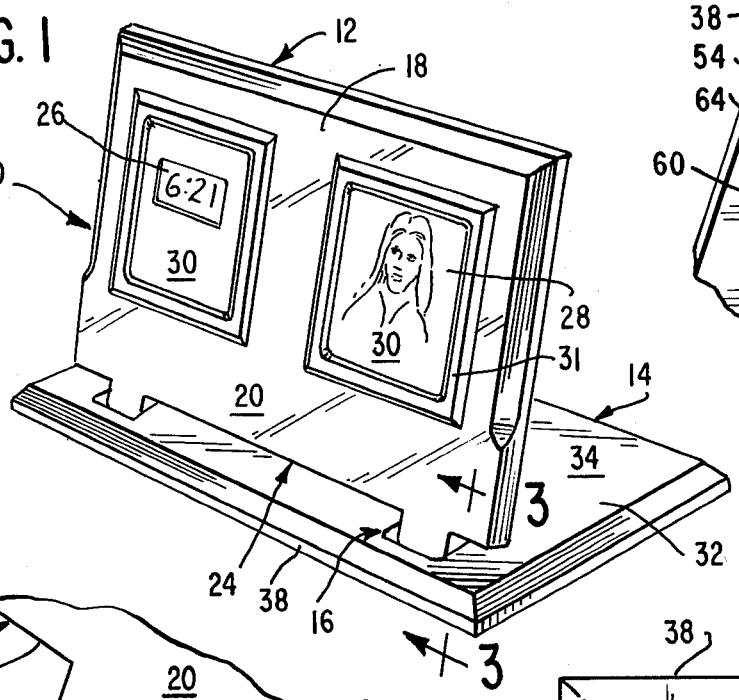
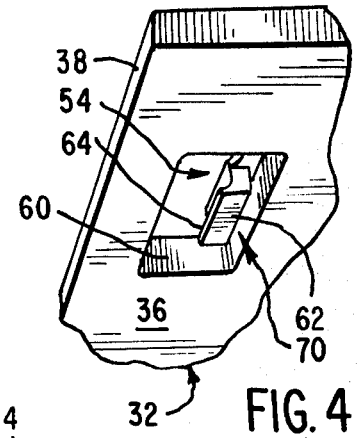
FIG. 4
FIG. 5
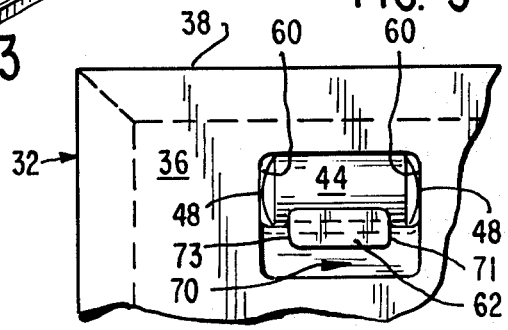
FIG. 2
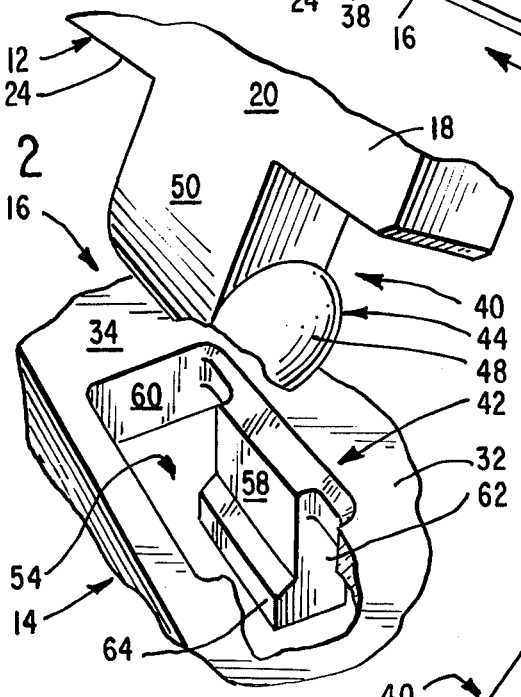
FIG. 3
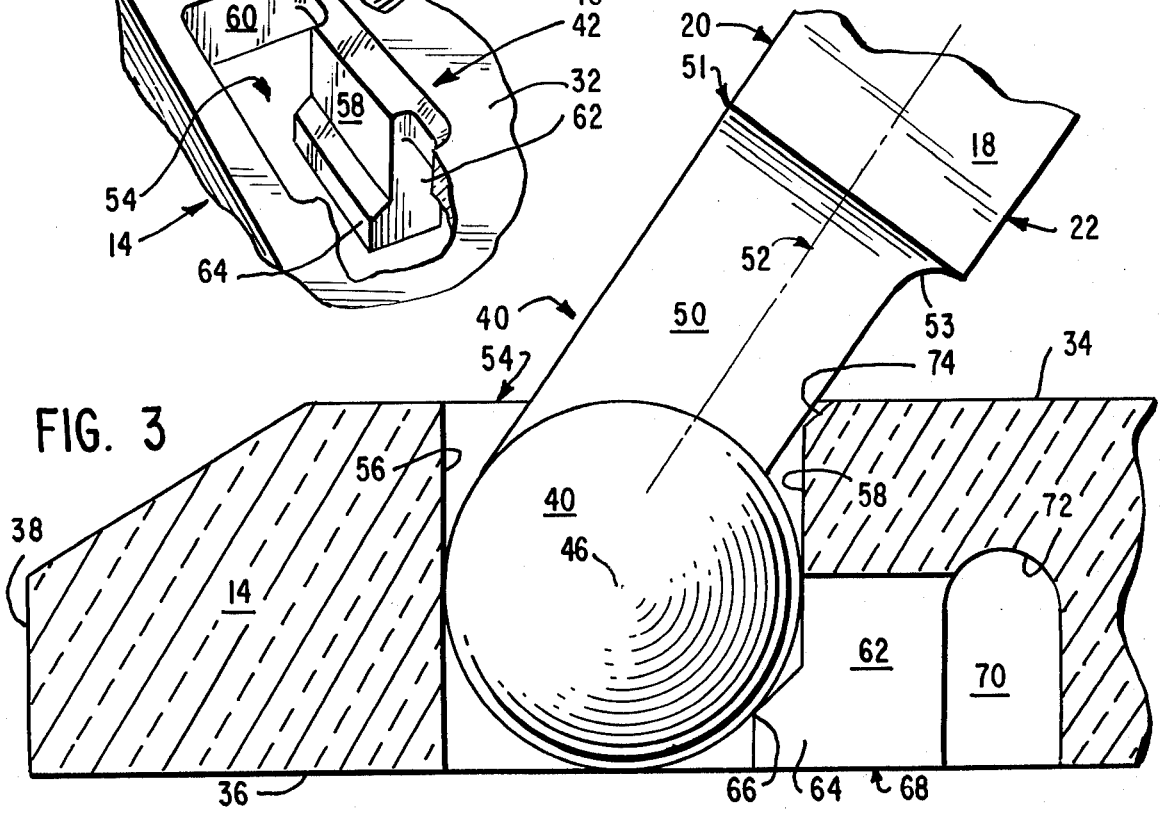

FIG. 6
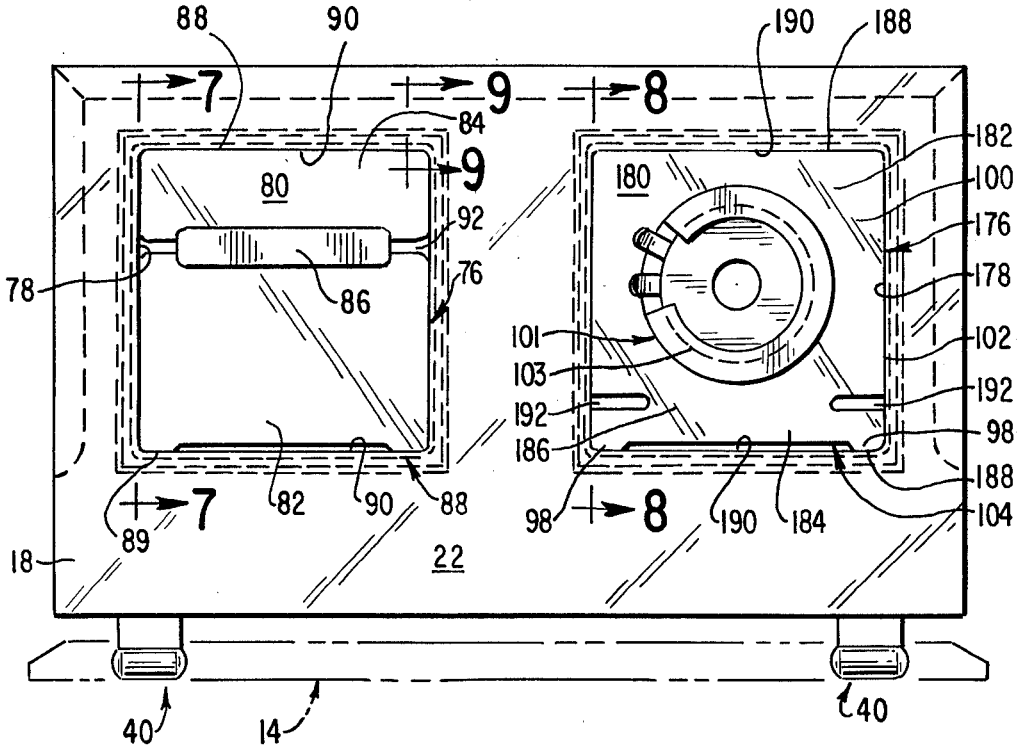
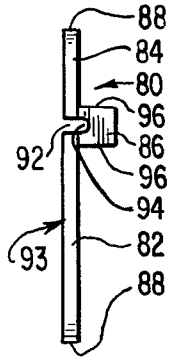
FIG. 7
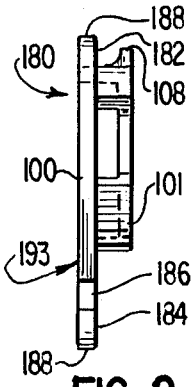
FIG. 8
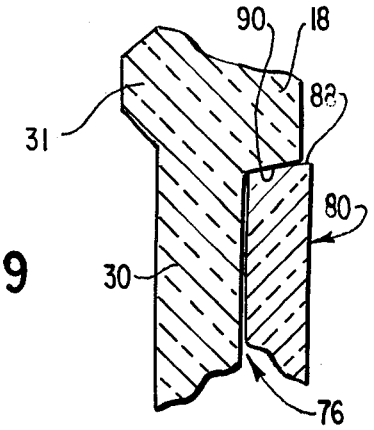
FIG. 9

257
242
256

11
242
258
254
256
234
214
232
257
11

255
272
232
234
12
257
12
262
268
270
236
237
14
342
361
370
370
362
362
363
363
314
354
332
14

354
355
334
355
370
362
332
336
475
16
470
465
473
471
463
460
456
454
462
465
473
470
471
463
460
414
432
442
16

454
455
432
434
455
462
470
436

18
570
570
542
514
562
562
560
560
532
554
563
18

554
555
532
534
555
562
572
536

DESK CLOCK AND DISPLAY STAND

CROSS-REFERENCE TO RELATED APPLICATION

This is a continuation-in-part of a previously filed application, Ser. No. 281,717 filed July 9, 1981, now abandoned.

TECHNICAL FIELD

This invention relates to stands for displaying clocks and pictures and more particularly, to tiltable desk clock display stands.

BACKGROUND OF THE INVENTION

Various mounting means have been disclosed in the past for allowing a generally small clock or picture to be positioned on a desk top. Illustrative of such clock designs are U.S. Pat. Nos. 2,069,894, 2,044,314, and 2,107,383 all to Mattman, U.S. Pat. No. 2,978,215 to Shanok et al. and U.S. Pat. No. Des. 259,184 to Francis et al. Previous designs generally have an upright member having a recess into which a clock is received to be viewed through the format of the device. There may also be a picture about the clock display. However, devices such as disclosed in the patent to Francis et al. having bases integral with upright members have proven difficult to mold. Previous devices either do not tilt or require bulky base members to permit tilting. These devices also do not disclose a tilting picture display stand either alone or in combination with a clock.

In today's office setting, it is desirable to be able to provide an aesthetically pleasing and yet functional display stand which is capable both of displaying a clock and a picture such as a family photo. It is desirable that this device be tiltable without having a bulky base member which distracts from the aesthetics of the display stand. The base member and tilting means should be unobtrusive and yet functional. It is also desirable to have a display stand that allows the owner to easily remove and replace pictures at will.

The display stand of the present invention satisfies these desires.

SUMMARY OF THE INVENTION

The present invention provides a display stand which can be placed on a desk to display a picture or photograph, a clock, or any combination of these. The display stand generally comprises a frame for displaying the clock or picture mounted on a base by a unique hinge means. The hinge means allows the owner to tilt the frame with respect to the base to any one of numerous desired angles. This allows improved viewing by providing a proper viewing angle that avoids the glare of overhead lights. Preferably, the base and frame are both made of a clear acrylic material.

The frame may be provided with one or more cells adapted to receive a unique display module having a biasing means to engage with and be retained by an interference fit within the cell. The display module retains a picture or clock for viewing by the owner through clear windows. The display module generally comprises a first plate portion and a second plate portion held together by a bridge section to bias at least a portion of opposite edges of the module against opposite borders of the cell. This retains the picture or clock in place and allows the owner to readily remove and replace the clock or picture as desired.

The hinge means generally comprises a female hinge element included with the base and a male hinge element included with the frame. The base includes the female hinge element and a base plate and the frame includes the male hinge element and a display panel. The female hinge element includes a socket opening toward the top surface of the base plate, a resilient finger which defines either part of a front wall or a back wall of the socket, and preferably a recess adjacent the finger such that the finger is between the recess and the socket. The male hinge element includes a generally cylindrical pin mounted on a post which is in turn mounted on the bottom side of the display panel. Preferably, the pin and socket are complementary. The pin is received in and has an interference fit with the socket and held in place by the finger. Preferably the pin is slightly larger in diameter than the width of the slot to provide proper biasing of the finger.

Numerous other advantages and features of the present invention will become readily apparent from the detailed description of the invention, the accompanying example, and the appended claims.

BRIEF DESCRIPTION OF THE DRAWINGS

FIG. 1 is a perspective view showing a display stand of the present invention including a base and a frame with a photograph and clock indicia visible through windows.

FIG. 2 is a enlarged, fragmentary exploded view of a male hinge element of the frame about to be received in a female hinge element of the base;

FIG. 3 is an enlarged, fragmentary cross-sectional view taken generally along the plane 3—3 of FIG. 1 showing the male hinge element received in the female hinge element;

FIG. 4 is an enlarged, fragmentary perspective view of the bottom of the base showing the bottom of the female hinge element;

FIG. 5 is an enlarged, fragmentary bottom plan view of the base showing the bottom of the female hinge element;

FIG. 6 is a rear elevational view of the display stand, with the frame in an upright, vertical position;

FIG. 7 is a side elevational view of the picture module taken generally along plane 7—7 of FIG. 6;

FIG. 8 is a side elevational view of the clock module taken generally along plane 8—8 of FIG. 6;

FIG. 9 is an enlarged, fragmentary view of the edge of one of the modules taken generally along plane 9—9 of FIG. 6 as the module contacts a cell border of one of the cells;

DETAILED DESCRIPTION OF THE PREFERRED EMBODIMENTS

Figures 10, 11, 12, 13, 14, 15, 16, 17, 18:
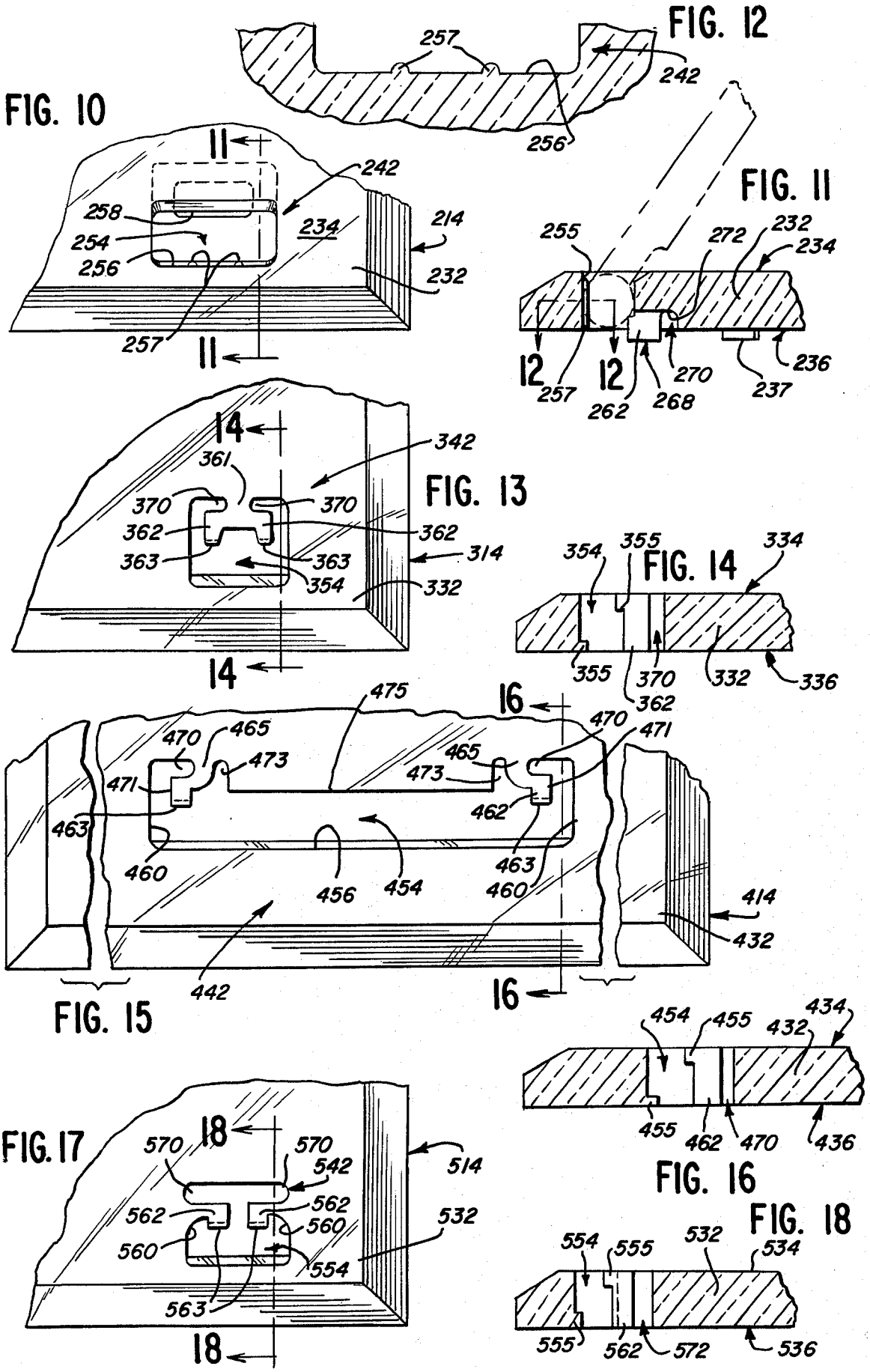
FIG. 10 is a fragmentary top plan view of a base having an alternative female hinge element.
FIG. 11 is a fragmentary, cross-sectional side elevation view of the alternative female hinge element taken generally along plane 11—11 of FIG. 10.
FIG. 12 is an enlarged fragmentary cross-sectional plan view of the alternative female hinge element taken generally along plane 12—12 of FIG. 11.
FIG. 13 is a fragmentary top plan view a base having a further alternative female hinge element.
FIG. 14 is a fragmentary, cross-sectional side elevation view of the alternative female hinge element taken generally along plane 14—14 of FIG. 13.
FIG. 15 is a fragmentary top plan view of a base having a still further alternative female hinge element.
FIG. 16 is a fragmentary, cross-sectional side elevation view of the alternative female hinge element taken generally along plane 16—16 of FIG. 15.
FIG. 17 is a fragmentary top plan view of a base having a still further alternative female hinge element.
FIG. 18 is a fragmentary cross-sectional side elevational view of the alternative female hinge element taken generally along plane 18—18 of FIG. 17.

While this invention is susceptible to embodiment in many different forms, there are shown in the drawings and will be described in detail, preferred embodiments of the invention. The present disclosure is to be considered as an exemplification of the principles of the invention and is not intended to limit the invention to the embodiments illustrated.

For ease of description, the display stand of this invention will be described in the normal upright position and such terms as top, bottom, front and back will be used with reference to this position. It will be understood that the display stand of this invention may be manufactured, used and sold in an orientation other than the position described.

Referring now to FIG. 1, the display stand 10 includes a frame 12 mounted on a base 14 by hinge means 16. The frame includes a display panel 18 having a front face 20, a back face 22 (FIG. 6) and sides, one side being a bottom side 24. The display panel 18 retains a display such as a digital clock 26, a picture 28 or both. The display is visible from the front of the panel through windows 30 which allow viewing of the picture 28 or time indicia 6:21 of the clock 26. The windows 30 may be beveled around their perimeter to provide decorative framing 31 and the windows should be of a transparent material such as acrylic. The entire display stand 10 may be made out of clear acrylic. The base 14 includes a base plate 32 having a top surface 34 and a bottom surface 36 (FIG. 5). The plate also has sides, one of which is a front side 38.

The hinge means includes a male hinge element 40 included with the frame 12 mounted on the bottom side 24 of the display panel 18 and a female hinge element 42 included with the base 14 adjacent the front side 38 of the base plate 32. This can best be seen in FIGS. 2-5. Alternatively the male hinge element may be included with the base 14 and the female hinge element included with the frame 12.

The male hinge element 40 includes a pin, preferably a generally cylindrical pin 44 having a pin axis 46 and two rounded, generally hemispherically shaped ends 48. The pin 44 is mounted at the end of a post 50 which has its other end mounted on the bottom side 24 of the display panel 18. The distance between the ends 48 of the pin 44 define the length of the pin and the distance along the ends of the post 50 defines the length of the post. The post 50 should have a thickness less than the diameter of the pin and be mounted flush with front face 20 of the display panel 18 as shown at 51 in FIG. 3 and should have a fillet 53, where the post meets the display panel.

Preferably the frame 12 includes two identically shaped male hinge elements 40 having generally cylindrical pins 44 with substantially aligned pin axes 46. The display panel 18 has a central plane 52 parallel to and equal distance from the faces. The pin axes are preferably offset from the central plane 52 as is best seen in FIG. 3.

The female hinge element 42 defines a socket 54 opening toward the top surface 34 and having a front wall 56, a back wall 58 and sidewalls 60. Although the female hinge element 42 is shown recessed into the base plate 32, it is understood that the female hinge element may be mounted on top of the base plate. The front wall 56 and the back wall 58 are substantially parallel and perpendicular to sidewalls 60. The distance between the sidewalls 60 defines the length of the socket 54 and the distance between the front wall 56 and the back wall 58 defines the width of the socket. Preferably the base 14 includes two identically shaped female hinge elements 42 with their respective front walls 56 and rear walls 60 being substantially coplanar. Each male hinge element 40 is then complementary to its respective female hinge element 42. Each set of hinge elements need not have the same length and width dimensions as the other set, but for ease of description they will be described as being equal in size.

For each male hinge element 40, the pin 44 and post 50 have lengths not greater than the length of their complimentary socket 54. The diameter of the pin 44 is approximately equal to the width of the complimentary socket 54 but is large enough to provide an interference fit in the socket and is preferably up to 0.005 inches larger in diameter than the width of the socket 54.

Also included in the female hinge element 42 is a resilient finger 62 which defines a portion of either the front wall 56 or the back wall 58. As shown in the FIGS., the finger 62 defines part of the back wall 58. The finger 62 may project into the socket 54 to provide an interference fit with the pin. The finger 62 is preferably provided with a ledge 64 having a pin engagement margin 66 to contact and coact with the pin 44. When the pin 44 is received in the socket 54, as in FIG. 3, the pin contacts the front wall 56, the back wall 58 and the pin engagement margin 66 along cocircular points. The finger 62 has an end 68 which is preferably coterminous with the bottom surface 36 of the base plate 32.

The female hinge element 42 preferably includes a recess 70 having a curved upper end 72. The recess is adjacent the finger 62 with the finger located between the recess and the socket 54. Preferably, the upper end 72 of the recess 70 is above the axis 46 of the pin 44 when it is received in the socket, i.e., closer to the top surface 34 of the base plate 32, than the axis 46 of the pin 44. As can best be seen in FIGS. 4 and 5, the recess 70 is preferably contiguous with the socket 54 and has a general U-shape. The recess 70 together with the socket 54 substantially surrounds the finger 62. Thus, finger sides 71 and 73 are preferably spaced from socket sidewalls 60 to provide a gap as can best be seen in FIG. 5.

The recess 70 allows the finger 62 to bend back as the pin 44 is inserted and remain biased against the pin to provide an interference fit retaining the frame 12 at a preferred angle of tilt with respect to the base 14. Alternatively the resiliency of the finger 62 provides the necessary bias and interference fit. The oversize of the pin 44 together with the biasing of the finger 62 helps retain the frame 12 at a desired angle of tilt. The female hinge element 42 is also preferably provided with a chamfer 74 between the back wall 58 of the socket 54 and the top surface 34 of the base plate 32. This provides clearance for the post 50 and acts as a stop as the frame 12 is tilted.

The ends 48 of the pin 50 should be generally hemispherical to coact with the sidewalls 60 of the socket 54 providing a camming action to align the pin as the male hinge element 40 is received by the female hinge element 42 (FIG. 5). The hinge elements may be integrally molded with the frame 12 and base 14. This design lends itself toward inexpensive and speedy manufacture. Although the frame 12 is shown in one configuration with respect to the base 14, it may be reversed to tilt away from the base.

The female hinge element can take on many other configurations as shown in FIGS. 10–18. One alternative embodiment for a female hinge element is shown in FIGS. 10–12. In this embodiment the base 214 includes the base plate 232 and the female hinge element 242 with socket 254. The front wall 256 of the female hinge element 242 includes at least one, and preferably two, spaced ribs or ridges 257. Alternatively, the ribs or ridges 257 can be located on the back wall 258 of the socket 254. The ribs or ridges coact with the pin such that the frame is retained on the base.

The ribs or ridges extend toward the top 234 and bottom 236 surfaces, but need not extend fully between the top and bottom surfaces of the base plate 232. The ridges 257 can best be seen enlarged in FIG. 12. The ridges are preferably half cylindrical in shape and extend above and below a point where they are contacted by the pin when received in the socket. The ridges 257 preferably extend into the socket 254 about 0.003 to about 0.007 inches from the front wall 256.

The ridges 257 have the particular advantage of providing an interference fit with a male hinge element received in the socket while facilitating small irregularities in the male hinge element or pin. Unlike an interference fit between two parallel walls, an interference fit using the ridges 257 accommodates small irregularities in the surface of the pin without affecting the operation of the hinge system. Control over the diameter of the pin during manufacture also becomes less critical.

In the embodiment of FIGS. 10–12, the pin is received in the socket 254 and is retained in the socket by the interference fit between the ridges 257 and the back wall 258 of the socket. The upper end 272 of the recess 270 is located below the axis of the pin so that the finger 262 can still flex backwards away from the pin, but most of the pressure is transferred into the base plate 232. This strengthens the finger 262 against breaking off from the remainder of the base plate 232.

Three or more feet 237 can be positioned on the bottom surface 236 of the base plate 232 to provide steady resting on a surface such as a desk. The end 268 of the finger 262 can extend beyond the bottom surface 236 of the base plate 232 and be substantially coterminous with the bottom of feet 237. A shoulder 255 can also be located on the corner between the front wall 256 and the top surface 234 to help retain the pin within the socket 254.

Another alternative embodiment for the base 314 and female hinge element 342 is shown in FIGS. 13 and 14. In this embodiment a pair of fingers 362 are retained on a common ear 361 with each finger between a recess 370 and the socket 354. The contact portion 363 of the fingers define a portion of the back wall of the socket 354. In this embodiment, the recesses 370 extend between the top 334 and bottom 336 surfaces of the base plate 332.

The ear 361 and finger 362 together have the appearance of a forked member with the contact portions of the fingers serving a function similar to the ridges disclosed above, e.g., accommodating small irregularities in the male hinge element. The fingers 362 flex toward the recesses 370 as the pin is received in the socket 357 to retain the pin in the socket. As best seen in FIG. 14, the socket can also be provided with a pair of shoulders 355, one along the bottom corner of the front wall 356 and one along the top corner of the back wall 357. This also helps retain the pin within the socket.

A still further alternative embodiment for the base 414 and female hinge element 442 is shown in FIGS. 15 and 16. While all of the embodiments for the hinge means can be used singly or in pairs, this particular embodiment is designed to be used singly. As before, the female hinge element 442 has the fingers 462 located between the recesses 470 and the socket 454. The recesses 470 extend between the top 434 and bottom 436 surfaces of the base plate 432. The contact portions 463 of the fingers 462 define a portion of the back wall of the socket.

The fingers 462 preferably extend on arms 465 which have a curved or arcuate shape. Each arm extends toward the front wall 456 and toward one of the side walls 460. There is open space between the finger sides 471 and the side walls 460 as the recess in effect wraps around the finger and behind it. To provide additional flex to the arms 465, slots 473 are located between the arms 465 and a central portion 475 of the socket. The central portion 475 is located behind the contact portions 463 so the pin coacts with the fingers 462 rather than the central portion. The contact portions 463 provide the same ridge-like advantages discussed above. In addition, as shown in FIG. 16, the socket 454 can also be provided with shoulders 455 to help retain the pin.

A still further variation for the base 514 and female hinge element 542 is shown in FIGS. 17 and 18. In this embodiment the fingers 562 are again located between the recesses 570 and the socket 554, and the recesses extend between the top 534 and bottom 536 surfaces of the base plate 532. As in the above embodiments, the contact portion 563 define a portion of the back wall of the socket 554. However, in this case, the fingers 562 extend from the side walls 560 and are spaced from each other. This provides flexibility for the fingers 562 as well as ease of manufacture. Once again, the contact portions 563 provide the advantages discussed above. The socket 554 can also be provided with shoulders 555 as discussed above to help retain the pin.

As can best be seen in FIG. 6, the display panel 18 preferably defines at least one, and more preferably two, recessed cells 76 and 176 having cell borders 78 and 178, 90 and 190 which, in the illustrated embodiment, forms a generally square configuration. The closed side of each cell is defined by one of the windows 30. The cells open to the back of the display panel 18 and the cell borders are preferably tapered from the windows 30 to the back face 22 with the largest opening toward the back face (FIG. 9).

The cells 76 and 176 are adapted to receive display modules such as a picture display module 80 and a clock display module 180. Each display module has a rigid first plate portion 82 and 182, and a rigid second plate portion 84 and 184 connected by a resilient bridge section 86 and 186. The plate portions define at least one plate portion slot 92 and 192 between them. The plate portions have substantially coplanar front faces 93 and 193. When the display modules 80 and 180 are received in the cells 76 and 176, opposite edges 88 and 188 are biased against respective opposite borders 90 and 190 of the cells 76 and 176.

The overall height of the display modules 80 and 180 as seen in FIG. 6 from the top to the bottom, is slightly greater, about 0.003 to about 0.006 inches, in height than their respective cells. This permits a biasing over the bridge section which to provide an interference fit which retains the module within its cell. The cells, 76 and 176 and display modules 80 and 180 are preferably rectilinear and the height of the first plate portion is preferably greater than the height of the second plate portion. The length of the bridge section, i.e. from left to right in the FIGS., should be less than the length of the portions.

In the case of the picture display module 80 as shown in FIG. 7, the plate portions 82 and 84 preferably define plate portion slot 92 having a length equal to the length of the plate portions. The plate portion slot 92 is bridged by the bridge section or bridge channel 86. The bridge channel 86 provides a gripping surface to facilitate removal of the module 80 from the cell 76. The bridge channel 86 has the general configuration of a "C" channel having a channel slot 94 and arms 96 respectively mounted on each plate portion. The channel slot 94 is substantially contiguous with the plate portion slot 92. This biases module edges 88 against cell borders 90 to retain the module 80 and picture 28 between the module and window 30. The module edges 88 may be provided with tabs such as 89 to engage the cell borders 90. Alternatively the picture display module 80 may have more than one bridge channel 86 or the bridge channel may be mounted at an angle, such as 45 degrees, with respect to the edges 88.

The clock display module 180 preferably is provided with at least one tab 98 extending from the opposite edge 188 of the second plate portion 184 opposite the plate portion slot on notch 192. The clock module display 180 may also be described as a plate 100 having a first side 102 and a second side 104 and notch 192. The notch 192 extends from the first side 102 adjacent to and substantially parallel to the second side 104. The tab 98 is then mounted on the second side 104 for at least a portion of the length parallel and adjacent to the notch 192. A plurality of such notches and tabs, with one at each corner, may be used. The notches need not be parallel to each other.

The clock module 180 is also provided with an annular member 101 mounted on the plate 100 and having an axis and a retaining member 103 extending toward the axis to retain the clock 26. The clock module 180 preferably also includes a gripping means such as ear 108 to facilitate removal of the module from the cell 176. A second picture may also be located about the clock indicia 6:21 as seen in FIG. 1.

The foregoing specification is intended to be illustrative and is not to be taken as limiting. Still other variations within the spirit and scope of this invention are possible and will readily present themselves to those skilled in the art. One such variation would be to use spherical pins which have an interference fit within the socket.

What is claimed:

1. A display stand suitable for retaining a clock or picture on a desk or the like, the stand comprising:

(a) a base including a base plate having a top surface, a bottom surface and sides;

(b) a female hinge element defining a socket having a front wall, back wall and side walls, the front and back walls being substantially parallel, the socket having a width between the front and back walls and a length between the side walls, the female hinge element also including a finger adjacent the socket and defining at least a portion of one wall of the socket;

(c) a frame including a display panel having a front face, a back face and sides, one side being a bottom side, the panel including at least one recessed cell adapted to retain a display; and (d) a male hinge element including a pin having a length not greater than the length of the socket and having a diameter approximately equal to the width of the socket, the male hinge element also including a post having two ends, the pin mounted on one end of the post, the female hinge element being adapted to receive and provide an interference fit with the male hinge element;

the male and female hinge elements being operably associated with the frame and base such that the frame is tiltably retained on the base.

2. The display stand of claim 1 wherein the female hinge element is included in the base with the male hinge element included with the frame, and the female hinge element includes a recess adjacent the finger with the finger between the recess and the socket.

3. The display stand of claim 2 wherein the recess has an upper end and sides, and opens toward the bottom surface of the base plate.

4. The display stand of claim 2 including a second finger and a second recess, each finger defining a portion of the same wall with each finger being located between one of the recesses and the socket.

5. The display stand of claim 4 wherein the recesses extend between the top and bottom surfaces of the base plate.

6. The display stand of claim 2 wherein the socket extends between the top and bottom surfaces and the recess has a general U-shape and is contiguous with the socket and together with the socket substantially surrounds the finger, the finger having an end and extending toward the bottom surface, the finger including a ledge extending into the socket and having a pin engagement margin, the pin when received in the socket contacting the socket front wall, back wall and the pin engagement margin along cocircular points.

7. The display stand of claim 1 including at least one ridge on one of the front and back walls, and extending toward the top and bottom surfaces, the ridge coacting with the pin such that the frame is retained on the base.

8. The display stand of claim 1 wherein the pin is generally cylindrical and has generally hemispherical ends which coact with the side walls of the socket to provide a camming action to align the pin in the socket as the male hinge element is received by the female hinge element.

9. The display stand of claim 1 wherein the frame includes two male hinge elements having generally cylindrical pins with axes substantially aligned and wherein the base includes two female hinge elements, the front walls of each socket being substantially coplanar, the male hinge elements being complimentary to the female hinge elements.

10. The display stand of claim 1 wherein the cell includes cell borders and a transparent window viewable from the front face of the display panel, the cell opening toward the back face and adapted to receive a display module.

11. The display stand of claim 10 including a display module having planar dimensions substantially equal to the planar dimensions of the cell, the module having edges and adapted to coact with the cell borders in an interference fit to retain the module in the cell, the module also adapted to retain a clock or picture viewable through the window.

12. A clock and display stand suitable for retaining a clock or picture on a desk, the stand comprising:

(a) a base including a base plate having a top surface, a bottom surface and sides, one side being a front side, the base also including two female hinge elements, each female hinge element defining a socket opening toward the top surface and having a front wall, back wall and side walls, the front and back walls being substantially parallel, the socket having a width between the front and back walls and a length between the side walls, each female hinge element also including a finger adjacent the socket and defining at least a portion of one wall of the socket and a recess adjacent the finger with the finger located between the socket and the recess;

(b) a frame including a display panel having a front face, a back face and sides, one side being a bottom side, the panel including at least one cell having cell borders and a transparent window viewable from the front face, the cell opening to the back face, the panel also including two male hinge elements mounted on the bottom side, the male hinge elements being respectively complimentary to the female hinge elements, each hinge element including a generally cylindrical pin having an axis and ends, the length of each pin less than or approximately equal to the length of its complimentary socket and having a diameter substantially equal to the width of its complimentary socket, each male hinge element also including a post having two ends with a length along the ends not greater than the length of the complimentary socket and a thickness less than the diameter of the pin, one end of the post being mounted on the bottom side of the panel with the pin mounted on the other end of the post, the female hinge element adapted to receive and provide an interference fit with the male hinge element so the base tiltably retains the frame; and (c) a display module having planar dimensions substantially equal to the cell and adapted to be received and retained in the cell, the display module including a rigid first plate portion and a rigid second plate portion having coplanar front faces, a common length and opposite edges, the plate portions being joined by a bridge section and defining at least one plate portion slot between the plate portions, such that when the module is received in the cell at least a portion of each opposite edge is biased against and engages at least a portion of respective opposite borders of the cell in an interference fit.

13. The clock and display stand of claim 12 wherein the bridge section has a length less than the length of the plate portions.

14. The clock and display stand of claim 12 wherein the display module is substantially rectilinear and the plate portions are spaced to define the plate portion slot with a length substantially equal to the length of the plate portions and the bridge section has the general configuration of a "C" channel having a channel slot substantially contiguous with the plate portion slot and having arms respectively mounted on each plate portion.

15. The clock and display stand of claim 12 wherein the display module is substantially rectilinear and the plate portions and bridge section are coplanar and the plate portion slot is a notch extending inward from one side of the module for a portion of the length of the module, the second plate portion having a height less than the height of first plate portion, the second plate portion including at least one tab extending from the opposite edge of the second plate portion and located opposite the notch to contact and coact with one of the borders of the cell to retain the module in the cell.

16. The clock and display stand of claim 15 wherein the module has two notches extending inward from opposing edges, both notches being substantially parallel to the opposite edge of the second plate portion and the second plate portion is provided with two tabs opposite the two notches.

17. The clock and display stand of claim 12 wherein the display module is adapted to retain a picture between the module and the window.

18. The clock and display stand of claim 12 wherein the display module is adapted to retain a clock with time indicia visible through the window.

19. The clock and display stand of claim 12 wherein in each female hinge element the socket extends between the top and bottom surfaces and the recess has a general U-shape and is contiguous with the socket and together with socket substantially surrounds the finger, the finger having an end extending toward the bottom surface, the finger including a ledge extending into the socket and having a pin engagement margin, the pin when received in the socket contacting the socket front wall, back wall and the pin engagement margin along cocircular points.

20. The clock and display stand of claim 12 wherein each pin has a diameter not greater than about 0.005 inches larger than the width of its complimentary socket.

21. A display stand frame adapted to be tiltably held by a display stand base having two female hinge elements each including a socket, the frame comprising:

(a) a generally rectangular panel having a front face, a back face and four sides, one side being a bottom side, the panel defining at least one cell having cell borders and a transparent window viewable from the front face, the cell opening toward the back and adapted to receive a display module to display a picture or time indicia a clock; and (b) two male hinge elements mounted on the bottom side of the panel, the male hinge elements being respectively complimentary to the female hinge elements and providing an interference fit with the sockets, each hinge element including a generally cylindrical pin having an axis and ends, the length of each pin not greater than the length of its complimentary socket and having a diameter substantially equal to the width of its complimentary socket, each male hinge element also including a post having two ends with a length along the ends not greater than the length of the complimentary socket and a thickness less than the diameter of the pin, one end of the post being mounted on the bottom side of the panel with the pin mounted on the other end of the post.

22. The display stand frame of claim 21 wherein the axes of the pins are substantially aligned and the panel has a central plane parallel to and equidistant from the faces, the pin axes being offset from the central plane.

23. The display stand frame of claim 21 wherein at least one of the cell borders is tapered from the window to the back face with the largest opening toward the back face.

24. A display stand base adapted to tiltably hold a display stand frame having two male hinge elements each including a generally cylindrical pin having an axis, the base comprising:

a generally rectangular plate having a top surface, a bottom surface and sides, one side being a front side, the plate including two female hinge elements adjacent the front side, the female hinge elements being respectively complimentary to the male hinge elements and providing an interference fit with the male hinge elements, each female hinge element defining a socket having a front wall, back wall and side walls, the front and back walls being substantially parallel, each socket extending between the top and bottom surfaces and having a width between the front and back walls and a length between the side walls, the length of each socket being greater than or equal to the length of its complimentary pin, the width of each socket being approximately equal to the diameter of its complimentary pin, each female hinge element including a finger adjacent a recess with the finger located between the recess and socket, the finger defining at least a portion of either the front or back wall of the socket, the finger including a ledge extending into the aperture and having engagement margin, each female hinge member adapted to receive its complimentary pin in the socket contacting the front wall, back wall and pin engagement margin along cocircular points.

25. The display stand base of claim 24 wherein each female hinge element includes a chamfer extending between the back wall of the socket and the top surface of the plate to provide clearance and a stop for the post.

26. The display stand base of claim 24 including at least one ridge on one of the front and back walls and extending toward the top and bottom surfaces, the ridge coacting with the pin such that the frame is retained on the base.

27. The display stand base of claim 24 including a second finger and a second recess, each finger defining a portion of the same wall with each finger being located between one of the recesses and the socket.

28. A display stand suitable for retaining a clock or picture on a support surface, the stand comprising:

(a) a base adapted to rest upon the support surface;

(b) a frame extending upwardly from the base, the frame defining a display panel having a front face and a rear face, the frame defining a recessed cell opening toward the back face of the panel, the cell being bordered by parallel top and bottom borders and parallel side borders perpendicular with respect to the top and bottom borders;

(c) a module for retaining a display within the cell, the module being shaped generally complementarily with the shape of the cell and including a generally flat plate having two faces and four edges, means defining a slot intermediate the ends of one edge of the module, the slot being adapted to face one border of the cell, the edges of the module adjacent the one edge and being generally parallel and spaced by a dimension greater than the distance between the respective borders of the cell such that the module may be releasably held within the cell;

(d) and gripping means formed integrally with the module for facilitating removal of the module from, and insertion of the module into, the cell.

29. The display stand of claim 28 wherein the frame is pivotally mounted on the base.

30. The display stand of claim 28 wherein the display is a picture.

31. The display stand of claim 28 wherein the display is a clock and module includes a member mounted on one of the faces and adapted to retain the clock.

32. A clock and display stand suitable for retaining a clock or picture on a desk, the stand comprising:

(a) a base including a base plate having a top surface, a bottom surface and sides, one side being a front side, the base also including at least one female mounting element, the female mounting element defining a recessed socket opening toward the top surface and having a front wall, back wall and side walls, the front and back walls being substantially parallel, the socket having a width between the front and back walls and a length between the side walls;

(b) a frame including a display panel having a front face, a back face and sides, one side being a bottom side, the panel including at least one cell having cell borders and a transparent window viewable from the front face, the cell opening toward the back face, the panel also including at least one male mounting element on the bottom side, the male mounting element being complimentary to the female mounting element, the male mounting element having a length less than or approximately equal to the length of the socket and having a thickness substantially equal to the width of the socket, the female mounting element adapted to receive the male mounting element so the base retains the frame at an angle with respect to the base; and (c) a display module having planar dimensions substantially equal to the cell and adapted to be received and retained in the cell, the module having opposite edges such that at least a portion of each opposite edge is biased against and engages at least a portion of respective opposite borders of the cell in an interference fit.

33. The clock and display stand of claim 32 wherein the female mounting element is a female hinge element and the male mounting element is a male hinge element and together they comprise a hinge means for tiltably mounting the frame on the base.

34. The clock and display stand of claim 32 wherein the module comprises a generally flat plate having two faces and four edges, one edge being provided with a slot and opposite edges adjacent the one edge being generally parallel and the dimension between the opposite edges being greater than the respective dimension of the cell into which the module is to be received such that the opposite sides cooperate with the cell to retain the module in the cell, the module also including a member mounted on one of the faces and adapted to retain a clock.

* * * * *